US005160067A

United States Patent [19]

Luber

[11] Patent Number: 5,160,067

[45] Date of Patent: Nov. 3, 1992

[54] CONTAINER AND LID APPARATUS

[76] Inventor: Gary A. Luber, 8611 Goldenwood Rd., Baltimore, Md. 21237

[21] Appl. No.: 705,949

[22] Filed: May 28, 1991

[51] Int. Cl.[5] ..... B67D 1/16

[52] U.S. Cl. ..... 222/109; 222/570; 222/572; 220/698

[58] Field of Search ..... 222/109, 570, 572; 220/701, 698, 695, 700

[56] References Cited

U.S. PATENT DOCUMENTS

| | | | |
|---|---|---|---|
| 1,696,240 | 12/1928 | Kircher, Jr. | 220/698 |
| 2,324,338 | 7/1943 | Tripp | 222/572 |
| 2,620,093 | 12/1952 | Rose | 222/109 |
| 2,646,193 | 7/1953 | Best | 220/701 X |
| 2,786,614 | 3/1957 | Giusto | 220/701 X |
| 4,022,344 | 5/1977 | Roamer | 220/701 X |
| 4,203,537 | 5/1980 | McAlister | 220/701 X |
| 4,240,568 | 12/1980 | Pool | 220/698 X |
| 4,949,884 | 8/1990 | Dahl | 222/570 |

*Primary Examiner*—Gregory L. Huson
*Attorney, Agent, or Firm*—Leon Gilden

[57] ABSTRACT

A container formed with an upper annular edge defining an outer annular edge and an inner annular edge, with a torroidal trough coextensively therebetween, with the trough formed with a plurality of apertures to permit fluid flow return to the container. A pour spout is formed originating interiorly of the inner annular edge adjacent the outer edge to enhance fluid flow from the container. The lid structure includes a central surface with a torroidal outer lid flange, with the outer lid flange including a plurality of equally spaced tabs radially directed exteriorly of the outer lid flange, with each of the tabs including a recess to accommodate manual grasping.

5 Claims, 4 Drawing Sheets 20
21
3
3
18
19
20
21

21
20
18
19
12
20
21
22
23
24
25

CONTAINER AND LID APPARATUS

BACKGROUND OF THE INVENTION

1. Field of the Invention

The field of invention relates to container apparatus, and more particularly pertains to a new and improved container and lid apparatus to enhance sealing and subsequent fluid flow from the container.

2. Description of the Prior Art

Lid structures in association with containers of various types are known in the prior art to enhance ease of fluid flow from the lid to enhance sealing of the container structure during periods of non-use. Such examples may be found in U.S. Pat. No. 4,299,340 to Hrytzak wherein a paint can attachment provides a trough for mounting to a container to enhance ease of fluid flow from the container.

U.S. Pat. No. 4,907,714 to Gatz sets forth a resilient paint can accessory of a generally hollow conical skirt to enhance fluid flow from the container, as well as providing a scatter shield on the container during a paint mixing procedure.

U.S. Pat. No. 4,911,319 to Dejean sets forth a paint can attachment to form a pouring spout mounted to the container.

U.S. Pat. No. 4,369,890 to Bennett sets forth a paint can collar to provide a return surface for fluids to be directed into the container.

As such, it may be appreciated that there continues to be a need for a new and improved container and lid apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of container apparatus now present in the prior art, the present invention provides a container and lid apparatus wherein the same provides for a lid structure to shieldingly secure contents of a container including pouring spout structure to enhance ease of fluid flow through the container during use. As such, the general purpose of the present invention, which will be described subsequently in greater detail, is to provide a new and improved container and lid apparatus which has all the advantages of the prior art container apparatus and none of the disadvantages.

To attain this, the present invention provides a container formed with an upper annular edge defining an outer annular edge and an inner annular edge, with a torroidal trough coextensively therebetween, with the trough formed with a plurality of apertures to permit fluid flow return to the container. A pour spout is formed originating interiorly of the inner annular edge adjacent the outer edge to enhance fluid flow from the container. The lid structure includes a central surface with a torroidal outer lid flange, with the outer lid flange including a plurality of equally spaced tabs radially directed exteriorly of the outer lid flange, with each of the tabs including a recess to accommodate manual grasping.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciated that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved container and lid apparatus which has all the advantages of the prior art container apparatus and none of the disadvantages.

It is another object of the present invention to provide a new and improved container and lid apparatus which may be easily and efficiently manufactured and marketed.

It is a further object of the present invention to provide a new and improved container and lid apparatus which is of a durable and reliable construction.

An even further object of the present invention is to provide a new and improved container and lid apparatus which is susceptible of a low cost of manufacture with regard to both materials and labor, and which accordingly is then susceptible of low prices of sale to the consuming public, thereby making such container and lid apparatus economically available to the buying public.

Still yet another object of the present invention is to provide a new and improved container and lid apparatus which provides in the apparatuses and methods of the prior art some of the advantages thereof, while simultaneously overcoming some of the disadvantages normally associated therewith.

Still another object of the present invention is to provide a new and improved container and lid apparatus wherein the same provides for a container with a readily removable lid to provide access to contents of the container, with the container including a pour spout to provide ease of fluid flow from the container exteriorly thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
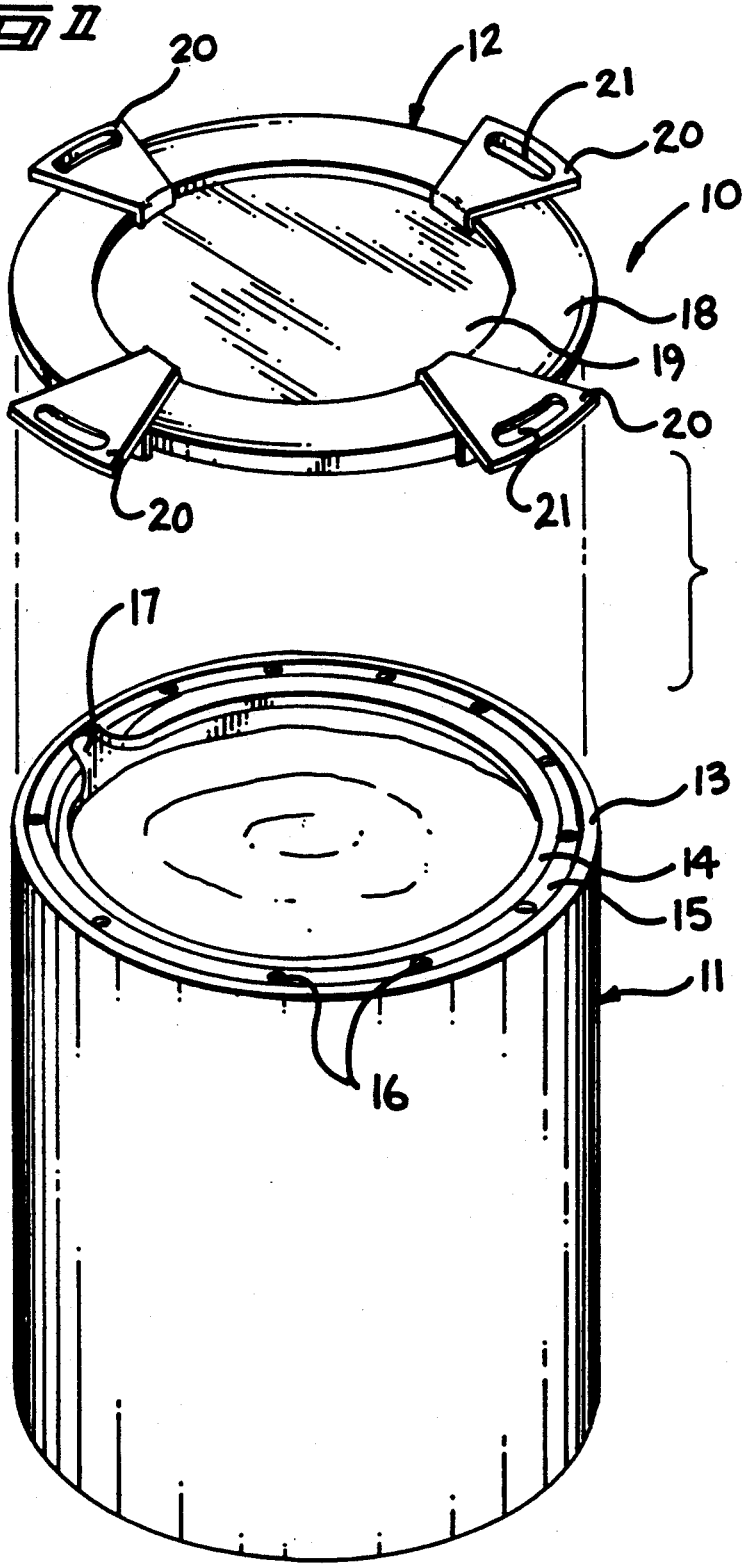
FIG. 1 is an isometric illustration of the instant invention in an exploded configuration.
Figure 2:
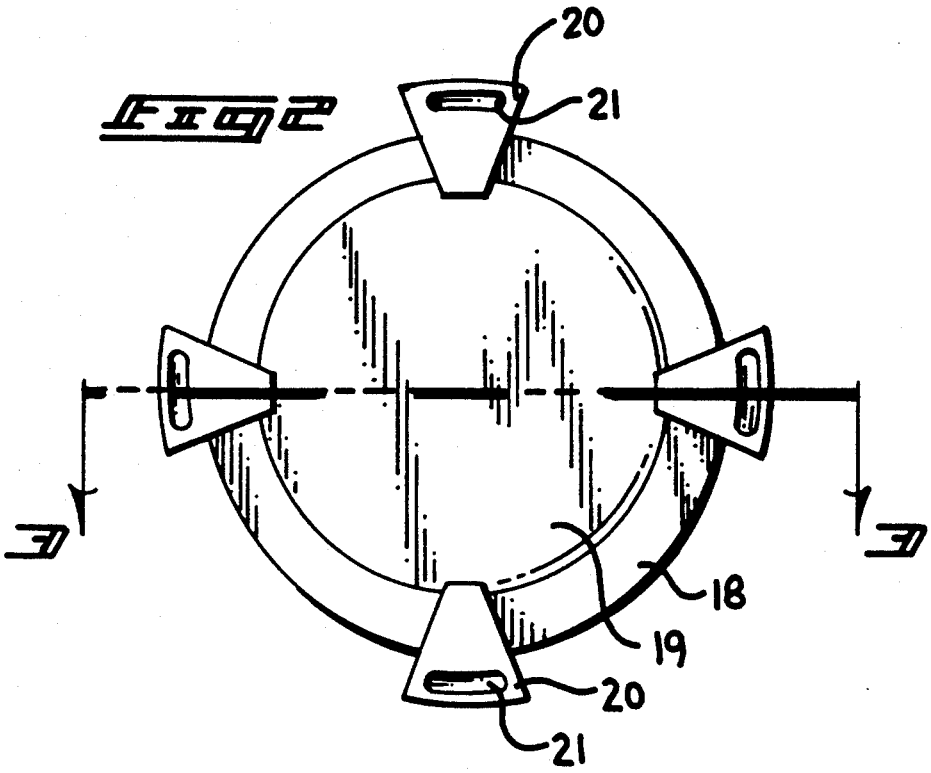
FIG. 2 is an orthographic top view of the lid of the instant invention.
Figure 3:
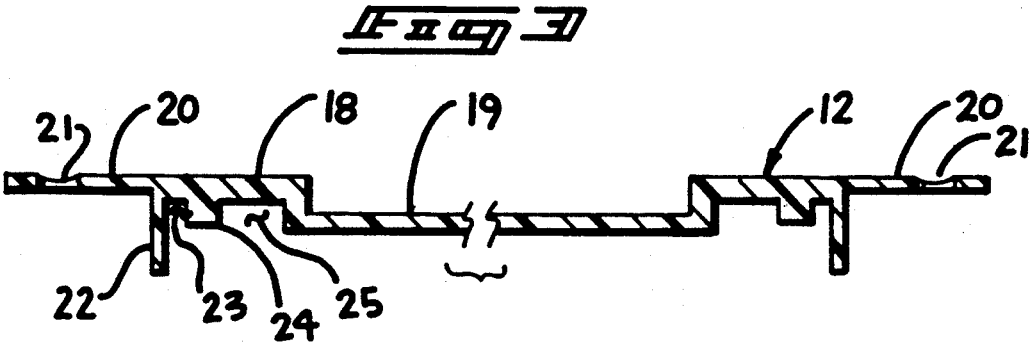
FIG. 3 is an orthographic side view of the lid, taken on the lines 3—3 of FIG. 2 in the direction indicated by the arrows.

With reference now to the drawings, and in particular to FIGS. 1 to 7 thereof, a new and improved container and lid apparatus embodying the principles and concepts of the present invention and generally designated by the reference numeral 10 will be described.

More specifically, the container and lid apparatus 10 of the instant invention essentially comprises a cylindrical container 11 removably mounting a lid 12 thereon. The container 11 includes a container upper outer annular edge 13 spaced from and concentric to a container inner annular edge 14 that is coplanar with the outer edge 13. A torroidal trough 15 is continuously presented between the inner and outer edges 13 and 14, with the trough 15 including a plurality of equally spaced trough apertures 16 to permit drainage interiorly of the container of paint and other fluids that may be contained within the container 11 and inadvertently directed into the trough 15.

Figure 4:
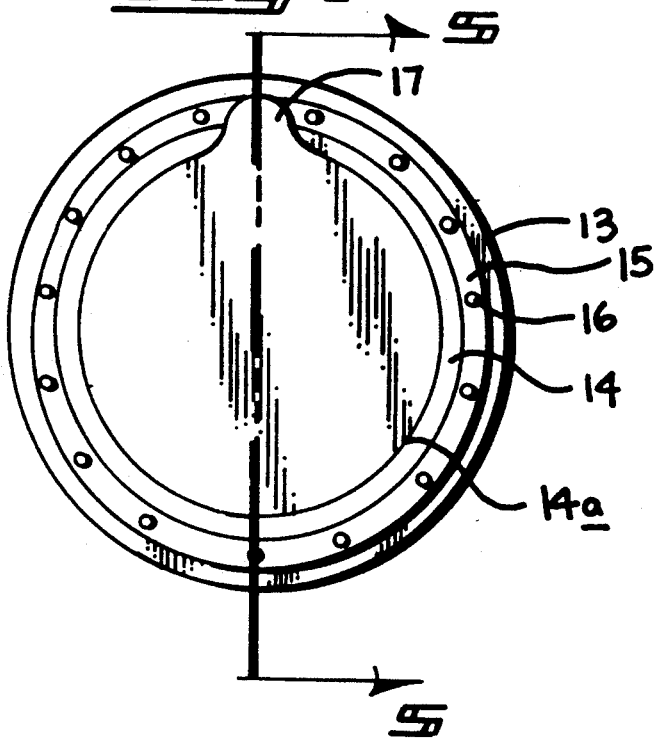
FIG. 4 is an orthographic top view of the container structure of the instant invention.
Figure 5:
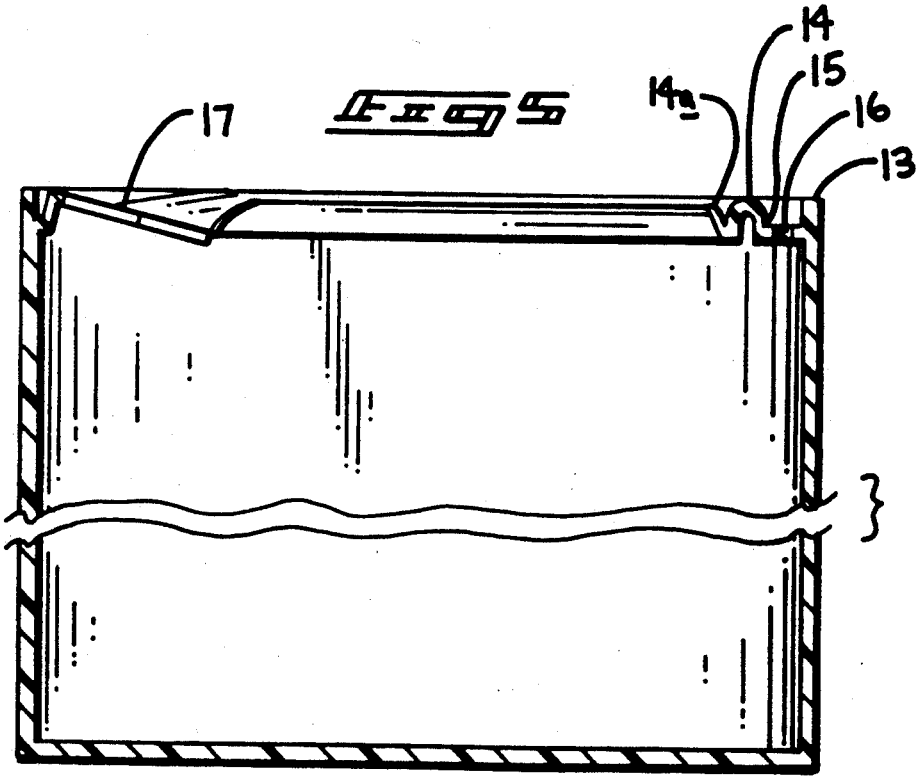
FIG. 5 is an orthographic view, taken on the lines 5—5 of FIG. 4 in the direction indicated by the arrows.
Figure 6:
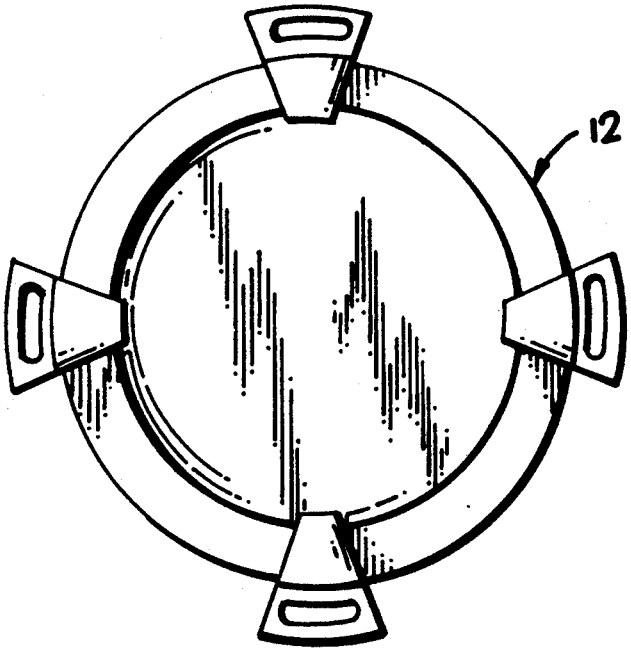
FIG. 6 is an orthographic bottom view of the lid of the instant invention.
Figure 7:
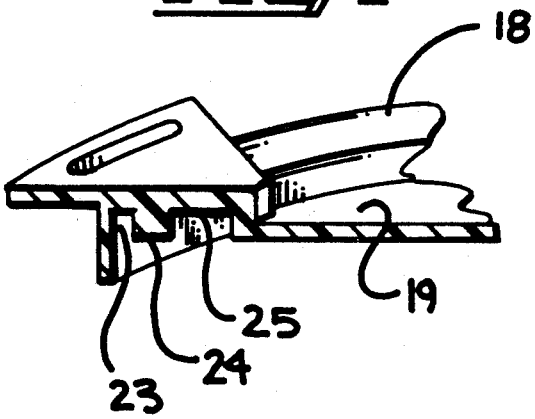
FIG. 7 is an isometric sectional view of the lid structure of the instant invention.

A pour spout trough 17 originates at the inner annular edge portion 14 and extends radially of the container to and adjacent the outer annular edge 13, with the trough defined by a concave configuration and narrowing of the trough from the inner edge to the outer edge structure, in a manner as illustrated in FIG. 4 for example. The spout trough 17 at the forward edge is aligned with the outer annular edge 13 (see FIG. 5) and angulated downwardly from the spout trough 17 outer edge to an interior portion of the trough adjacent the origination area of the inner annular edge 14. An annular wiping edge 14*a* is provided coaxially positioned interiorly of the inner annular edge 14 and the pour spout trough having its rear end intersecting the wiping edge 14*a*. The upper end of the wiping edge 14*a* is defined by a continuous web originating from the outer edge 13 and the wiping edge coplanar with the inner edge 14 and outer edge 13. Further, the top of the container 11 may be constructed as an insert (not shown) to be secured to the top of a conventional paint container.

The lid 12 includes a lid central surface 19 that is recessed below a torroidal outer lid flange 18 that is in a spaced relationship above the central surface 19. Plural pairs of grasping tabs 20 are oriented at ninety degrees offset to one another and radially aligned relative to the lid 12 and extending exteriorly of the lid beyond the outer lid flange 18. Each tab 20 includes recess 21 positioned between the outer lid flange 18 and an outermost portion of each tab 20 to accommodate manual grasping of the associated tab 20 to assist in removal of the lid 12.

The lid 12 is defined by an outer cylindrical skirt 22 orthogonally oriented relative to each of the tabs 20 and positioned at a forward edge of the outer lid flange 18. The skirt 22 forms a seal with the outer surface of the container 11. A first annular cavity 23 defined by a predetermined width equal to a predetermined width defined by the outer annular edge 13 to receive the edge 13 therewithin. A trough projection 24 is arranged for positioning within the torroidal trough 15 and is of a further width equal to a further width defined by the torroidal trough 15 to effect a sealing relationship of the lid and the container. A second annular cavity 25 positioned coaxially and interiorly of the first annular cavity 23 is concentric with the first annular cavity 23 to receive the inner edge 14 and associated pouring spout trough 17 therewithin.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A container and lid apparatus, comprising in combination, a container, the container is of a cylindrical configuration and including a container cylindrical side wall, with the side wall including an upper outer annular edge, and an upper inner annular edge spaced from and concentric with the outer annular edge, with a torroidal trough defined between the outer annular edge and the inner annular edge, and the torroidal trough including a plurality of apertures directed therethrough, and an interior annular wiping edge is formed as a part of a single web with the inner annular edge and the outer annular edge, with the interior annular wiping edge coplanar with the inner annular edge and outer annular edge, and a concave pouring spout trough originating at the interior annular edge and extending over the torroidal trough and terminating contiguous to the outer annular edge, with the pouring spout trough inclined downwardly from the outer annular edge to the inner annular edge, and a lid member securable over the outer annular edge and the inner annular edge.

2. An apparatus as set forth in claim 1 wherein the lid member includes a torroidal outer lid flange surface, the lid flange surface in surrounding relationship relative to a central surface, the central surface recessed below the flange surface, and a plurality of grasping tabs integrally mounted to the flange surface extending exteriorly from the flange surface and spaced apart ninety degrees relative to one another.

3. An apparatus as set forth in claim 2 wherein each tab includes a recess formed between the flange surface and an outer terminal edge of each tab, with each slot arranged to accommodate manual grasping to assist in removal of the lid member relative to the container.

4. An apparatus as set forth in claim 3 wherein the lid member further includes an outer cylindrical skirt defined by a predetermined diameter with the container defined by a predetermined external diameter complementarily received within the skirt to permit the skirt to form a seal about the upper outer annular edge of the container.

5. An apparatus as set forth in claim 4 including a first annular cavity formed within the lid member underlying the flange surface, with the first annular cavity defining a predetermined width and the outer annular edge defined by an equal predetermined width to complementarily position and receive the outer annular edge within the first annular cavity, and a cylindrical trough projection positioned interiorly of the first annular cavity within the lid member underlying the flange surface wherein said trough projection is defined by a projection width substantially equal to a torroidal trough width defined by the torroidal trough, and a second annular cavity positioned underlying the flange surface between the trough projection and the lid central surface to receive the inner annular edge and the pouring spout trough therewithin.

* * * * *